US008662314B2

(12) United States Patent
Jones et al.

(10) Patent No.: US 8,662,314 B2
(45) Date of Patent: Mar. 4, 2014

(54) SORTING APPARATUS AND METHOD UTILIZING A MECHANICAL DIVERTER

(75) Inventors: Peter T. Jones, Kennewick, WA (US); Philip L. Hoffman, Walla Walla, WA (US); Hans G. Halmberger, Milton-Freewater, OR (US); Ken McGarvey, Walla Walla, WA (US); James Ruff, Walla Walla, WA (US); Mike Lemke, Touchet, WA (US); Timothy Reardon, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 224 days.

(21) Appl. No.: 13/373,961

(22) Filed: Dec. 6, 2011

(65) Prior Publication Data

US 2012/0138512 A1 Jun. 7, 2012

Related U.S. Application Data

(63) Continuation-in-part of application No. 12/383,199, filed on Mar. 19, 2009, now Pat. No. 8,220,639.

(51) Int. Cl.
*B07C 5/06* (2006.01)

(52) U.S. Cl.
USPC ..... 209/656; 209/552; 209/639; 209/44.2; 209/644; 209/938

(58) Field of Classification Search
USPC ..... 209/44.2, 552, 639, 644, 651, 652, 653, 209/654, 656, 938, 939
See application file for complete search history.

(56) References Cited

U.S. PATENT DOCUMENTS

| | | | | |
|---|---|---|---|---|
| 3,872,306 | A | 3/1975 | Palmer | |
| 4,081,362 | A | 3/1978 | Chamberlin et al. | |
| 4,168,005 | A * | 9/1979 | Sandbank | 209/552 |
| 4,314,645 | A * | 2/1982 | Perkins et al. | 209/638 |
| 4,324,336 | A * | 4/1982 | Sandbank | 209/589 |
| 5,042,637 | A | 8/1991 | LaVars et al. | |
| 5,092,470 | A * | 3/1992 | Hakansson | 209/586 |
| 5,197,607 | A * | 3/1993 | Hakansson | 209/586 |
| 5,509,537 | A * | 4/1996 | Crismon et al. | 209/577 |
| 5,887,073 | A * | 3/1999 | Fazzari et al. | 382/110 |
| 5,979,667 | A * | 11/1999 | Earl | 209/657 |
| 2010/0236994 | A1 | 9/2010 | Hoffman et al. | |

OTHER PUBLICATIONS http://www.magnusoncorp.biz/ccm.html "Automatic Corn Cutter" 6 pages of website, printed Jun. 18, 2010.

* cited by examiner

*Primary Examiner* — Terrell Matthews
(74) *Attorney, Agent, or Firm* — Paine Hamblen, LLP

(57) ABSTRACT

The present invention is an apparatus and method for sorting foreign material and undesirable articles from a product stream. A mechanical diverter having a concave shape is responsive to an inspection station coupled to the product stream. The mechanical diverter is employed to effectively launch or otherwise redirect undesirable articles in an alternate path. In addition, an air ejector in one form of the invention is provided and is responsive to the inspection station and is employed to dislodge foreign material from the product stream.

13 Claims, 13 Drawing Sheets

SORTING APPARATUS AND METHOD UTILIZING A MECHANICAL DIVERTER

RELATED PATENT DATA

This patent application is a Continuation-In-Part of U.S. patent application Ser. No. 12/383,199, and which was filed on Apr. 19, 2009.

TECHNICAL FIELD

The present invention relates to a sorting apparatus and method, and more specifically to a sorting apparatus and method for separating articles in a product stream using a mechanical diverter responsive to a machine vision system. The present invention also includes, in one form of the invention, a combination of a sorting apparatus that uses an air ejector for foreign material removal and a mechanical diverter for redirecting undesirable articles from a product stream.

BACKGROUND OF THE INVENTION

Sorting methods and machines have been known and practiced for many years in the production of goods including comestible articles. The machines found in the art include types that utilize reflecting electromagnetic radiation in the form of light to determine the optical reflective characteristics of the articles in the product stream using color as a determinant followed by an ejector to successfully remove offending articles. A notable example of such a sorter is the High Speed Mass Flow Sorting Apparatus for Optical Inspection and Sorting Bulk Food Products as shown in U.S. Pat. No. 5,887,073, and which is assigned to Key Technology, Inc.

Successful removal of offending or undesirable articles has been practiced to varying degrees of efficiency using several different approaches including air ejection and mechanical diversion. Experience has shown that air ejection techniques are suitable for a wide range of article types, but is best applied for smaller, less dense articles that can be easily influenced by a jet of fluid. Examples of articles suitable for air ejection include peas, corn, potato strips, potato crisps, and foreign material. Air ejection as commonly practiced utilizes a plurality of electrically controlled valves that are individually controlled by a machine vision system, and targeted toward offending or undesirable articles in a product stream. Thus, the undesirable articles are dislodged from their course of travel and caused to take an alternate path, removing them from the product stream.

Alternatively, mechanical diversion is similarly suitable for a wide range of articles, however, it is best applied for larger articles that are less susceptible to the physical influence caused by a jet of fluid. Examples of articles suitable for mechanical diversion include oranges, grape fruit, onions, and potatoes. Mechanical diverters are known in the art to require more frequent maintenance than air ejectors. In addition, mechanical diverters are more prone to undesirably bruised articles during a diversion.

An example of a sorter using a mechanical diversion arrangement is found in U.S. Pat. No. 5,979,667, where a rigid paddle is taught, and which selectively strikes articles from the product stream thereby forcing them into another path of travel. In this reference, a pulsed light sensor receives reflected light from a product stream of articles such as tomatoes. A color comparator utilizes information supplied from the pulsed light sensor to identify undesirable articles in the product stream. A pneumatically operated, and electrically controlled paddle is positioned so that undesirable articles are expelled from the product stream by striking them during their movement along a path of travel to send them to an alternate location. This reference also teaches the option of reversing the logic so that the moveable paddle is used to divert acceptable articles. Unfortunately, the striking action of the paddle upon the article during its course of travel has the potential to bruise the articles, thereby reducing their perceived value.

Another example of relevant art is found in U.S. Pat. No. 5,509,537 where a flexible finger is used to selectively strike undesirable articles from the product stream. Here, the flexible finger is presented as an alternative to the paddle described, above. One might expect that the striking flexible finger might decrease any adverse effects caused by the impacts made to the articles traveling in the product stream. However, it would appear that a flexible finger would also decrease the accuracy of the ejection operation by nature of its flexibility.

The present invention overcomes this and other limitation of the prior art. For instance, none of the aforementioned teachings, or other examples in the art disclose a sorter that utilizes a mechanical diverter having a concave shape that can gently redirect undesirable articles to another path of travel for further processing. In addition, the art does not teach the combination of utilizing both an air ejection device, and mechanical diversion in a single sorter arrangement.

SUMMARY OF THE INVENTION

One aspect of the present invention relates to a sorting apparatus for separating articles in a product stream, and which includes an endless belt conveyor configured to launch articles from the product stream in a first trajectory; an inspection station coupled to the product stream and operable to provide a routing signal based on inspection of the product stream; and a diverter comprising a launching block having a concave surface, and located in downstream relation relative to the inspection station, and controlled by the routing signal, and wherein the diverter has a retracted position where articles extend their travel in the first trajectory, and an extended position where articles interact with the diverter in a gliding manner along the concave surface to effectively launch the articles into a second trajectory.

Another aspect of the present invention is to provide a sorting apparatus for separating articles in a product stream, and which includes a conveying means to transport and launch the articles in a product stream in a first trajectory; an inspection means coupled to the product stream to provide a first and second routing signal based upon the inspection of the product stream; and a diverter means having a concave member, and controlled by the first and second routing signals and located in downstream relation to the inspection station to pass articles in the first trajectory in response to the first routing signal, and to further urge articles to assume a second trajectory in response to the second routing signal by urging the articles to glide along the diverter so that the articles are effectively launched into a second trajectory.

Yet another aspect of the present invention is to provide a sorting apparatus for separating articles in a product stream having acceptable articles, unacceptable articles, and foreign material, and which includes an endless belt conveyor configured to launch the product stream in a first trajectory; an inspection station coupled to the product stream and operable to provide a plurality of routing signals based upon the inspection of the product stream; a first air ejection station located in downstream relation to the inspection station, and controlled by a first portion of the plurality of routing signals, and configured so as to expel the foreign material from the product stream product stream in a second trajectory; and a concave shaped diverter located in downstream relation to the inspection station and which is controlled by a second portion of the plurality of routing signals, and which is operable to launch undesirable articles from the product stream so that they become separated from the desirable articles moving in the product stream.

Still another aspect of the present invention relates to a sorting apparatus which includes a conveyor for transporting a multiplicity of articles in a continuous product stream, and which includes acceptable and unacceptable articles, and foreign material, and which further propels the product stream into a first path of travel; an inspection station positioned along the first path of travel, and wherein the inspection station visually inspects the product stream so as to identify the respective acceptable articles, unacceptable articles and foreign material, and further generates a plurality of routing signals following the inspection of the product stream; and a diverter assembly located downstream of the inspection station, and in spaced relation relative to the conveyor, and wherein the diverter assembly is controlled by the plurality of routing signals supplied by the inspection station, and further has a first and second plurality of selectively moveable launching blocks, and wherein the second plurality of launching blocks are located downstream of, and in substantially gravitationally feeding alignment with, the respective first plurality of selectively moveable launching blocks, and wherein the individual moveable launching blocks of the first and second plurality each have a first, retracted position, and a second, extended position, and wherein, when the individual launching blocks of the first and second plurality are both in the retracted position, the individual articles moving along in the product stream move along a second path of travel; and wherein when the individual moveable launching blocks of the first plurality are in the extended position, the individual articles moving along in the product stream move along a third path of travel; and wherein when the individual moveable launching blocks of the first plurality are in a retracted position, and the second plurality of launching blocks are in an extended position, the individual articles travelling along in the product stream move in a fourth path of travel, and wherein the second, third and fourth paths of travel effect the sorting of the articles in the product stream.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

First Form

Figure 1:
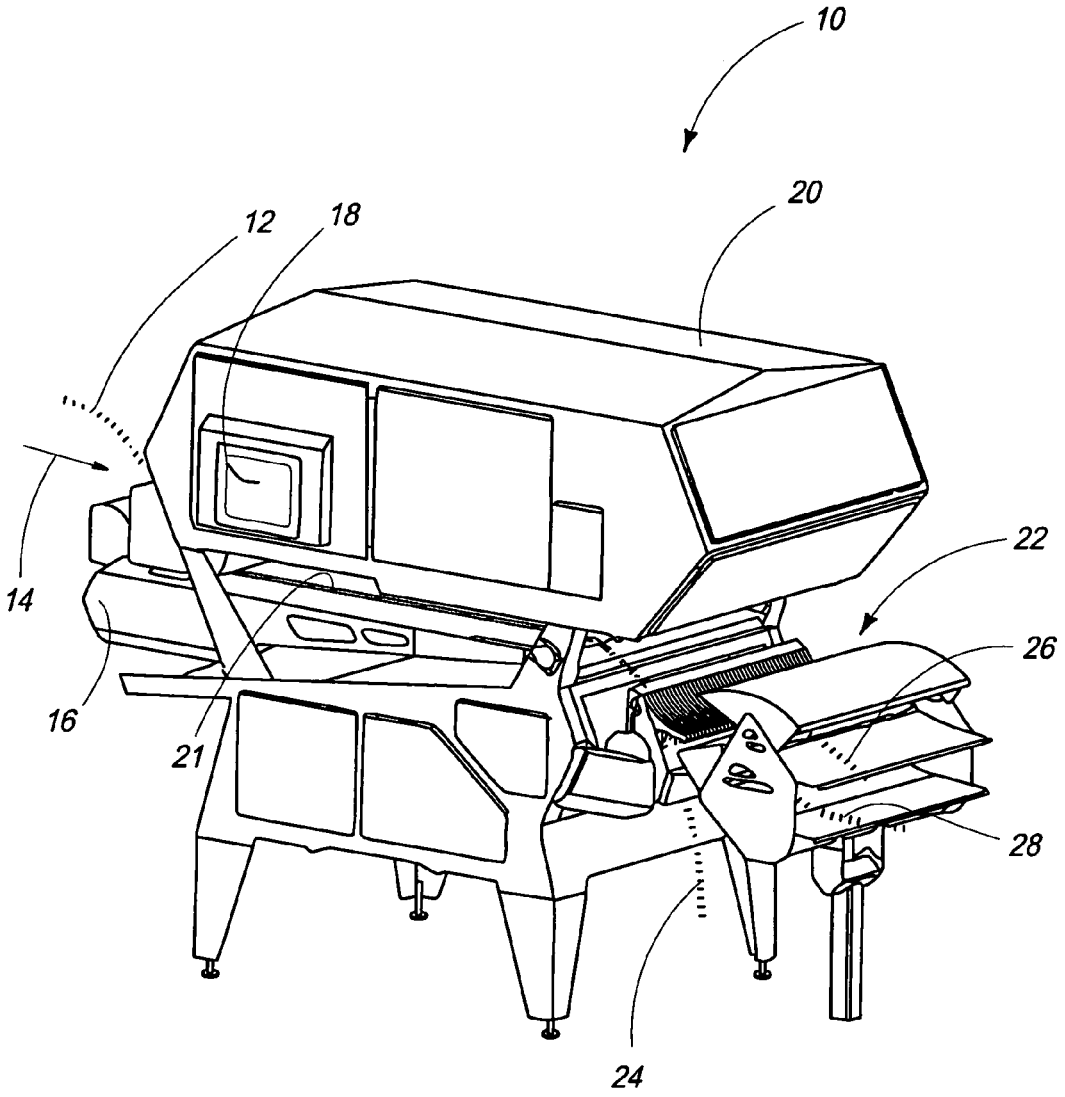
FIG. 1 is an isometric diagram of a first form of the sorting apparatus of the present invention.

Referring now to FIG. 1, a first form of an apparatus for sorting articles, and which utilizes a mechanical diverter is shown, and is generally identified by the numeral 10 and will be referred to as a "sorter" in this disclosure. The sorter 10 is installed in a processing line adjacent to other equipment in a continuous production system. The apparatus 10 is located in a processing line at a strategic location where the quality of each article is ascertained and is routed for further processing.

A stream of articles, or incoming product stream 12 is introduced at an infeed end of the sorter 10. In practice, the product stream 12 may be composed of any article of manufacture or production, and often includes both desirable articles which meet the specification of quality, and undesirable articles which fall outside the specification of quality. Furthermore, the incoming product stream 12 may contain other materials which have a different nature than the articles and will hereinafter be referred to as foreign material. The product stream 12 is composed of individual articles traveling in a direction which is generally depicted by the flow arrow labeled 14. The product stream 12 may include individual articles that are moving in concert at a generally uniform speed and traveling in the product flow direction 14.

Articles in the product stream 12 are introduced to an endless belt conveyor 16 that is integrated into the sorter 10 for transporting the articles through the sorter 10. The conveyor 16 includes an endless belt selected to provide a sufficient amount of friction for stabilizing the articles in the product stream 12 as they are transported in the flow direction 14.

The sorter 10 includes a user interface 18 that enables an operator, (not shown), to observe and control various operational aspects of the sorter 10. From the user interface 18, an operator can view representations of the articles in the product stream 12 as they are processed in the sorter 10. In addition, the user interface 18 provides a means for the operator to configure the operation of the sorter 10 to enable the sorter to make a determination between acceptable articles, undesirable or unacceptable articles, and foreign material.

Articles in the product stream 12 are transported along a path of travel to the end of the conveyor 16 where they are launched into a given trajectory. The product stream 12 is composed of articles that are scattered across both a width and length of the conveyor 16, and are illustrated in a single-file manner in FIG. 2. During this transport, articles and foreign material in the product stream 12 are viewed or otherwise interrogated by an inspection station 20 across the width of the sorter 10. The inspection station 20 includes sensors that provide signals representative of the physical parameters of articles and foreign material in the product stream 12, and a processor that uses these signals, in combination with information provided by an operator, to make a determination of the projected routing of the articles, and foreign material in the process line. The inspection station 20 is operable to process a plurality of articles as they travel through the sorter 10, scanning the articles, and grouping them into objects. These objects are further ordered into virtual lanes, one of which is indicated by the numeral 21. Each virtual lane 21 is composed of objects following one-another in a time oriented relationship.

A routing assembly 22 is positioned in downstream receiving relation relative to the inspection station 20, and is further configured to respond to directions provided by the inspection station 20. The routing assembly 22 includes a plurality of active diverters that are capable of urging articles, and foreign material in the product stream 12 to follow predefined paths of travel. One such path of travel is a foreign material path of travel 24. A second path of travel is an acceptable article path of travel 26 provided for acceptable articles in the product stream 12 to follow. Another such path of travel is an unacceptable article path 28 which is established for unacceptable articles moving in the product stream 12.

Figure 2:
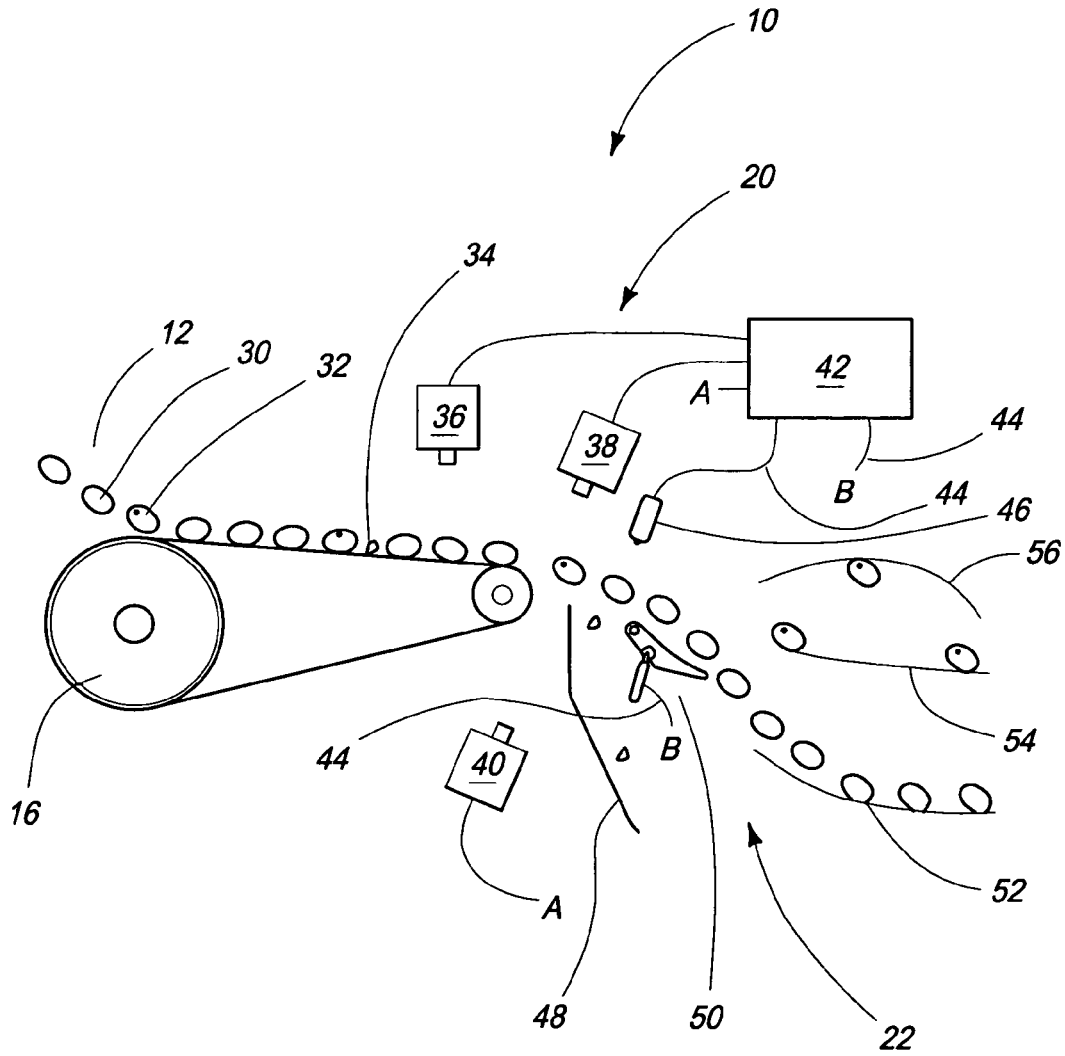
FIG. 2 is a block schematic diagram of the first form of the sorting apparatus, and which details the flow of articles from the product stream through the apparatus.
Figure 5:
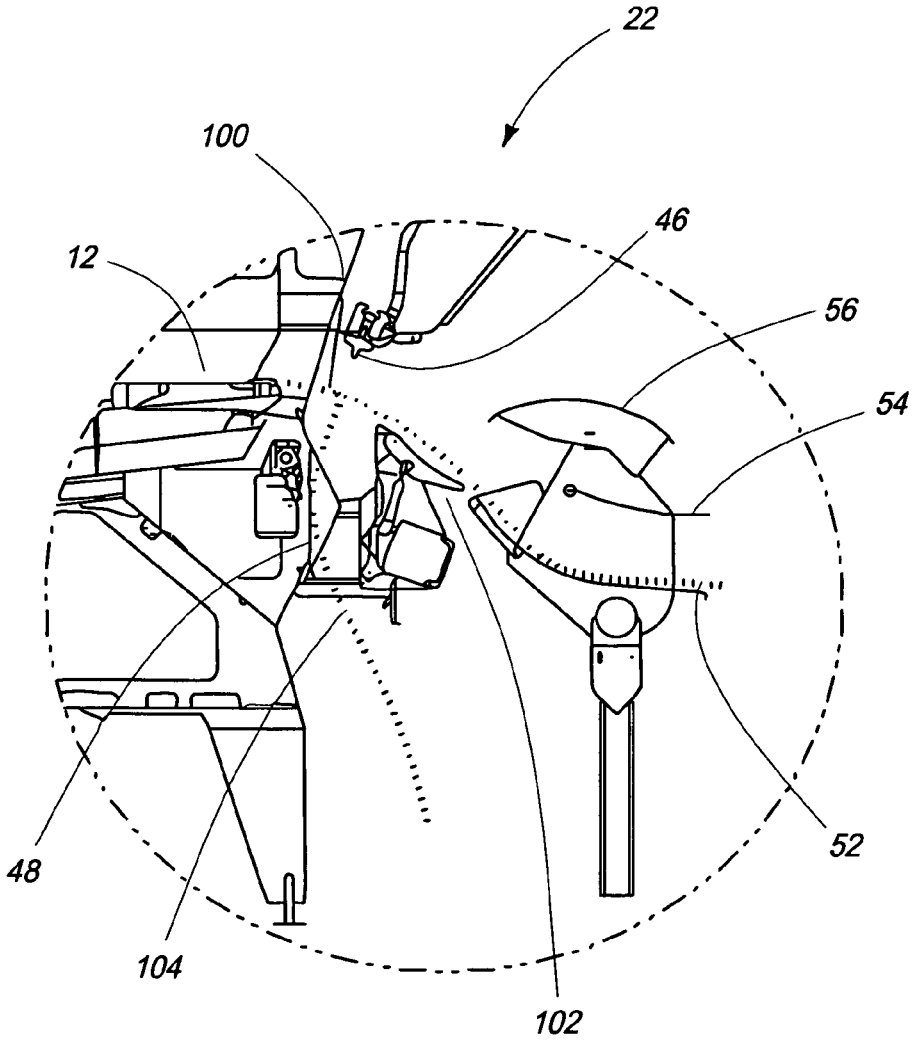
FIG. 5 is a side elevation view of a separation assembly of the first form of the sorting apparatus showing a trace of a foreign material trajectory and another trace showing a normal trajectory.
Figure 6:
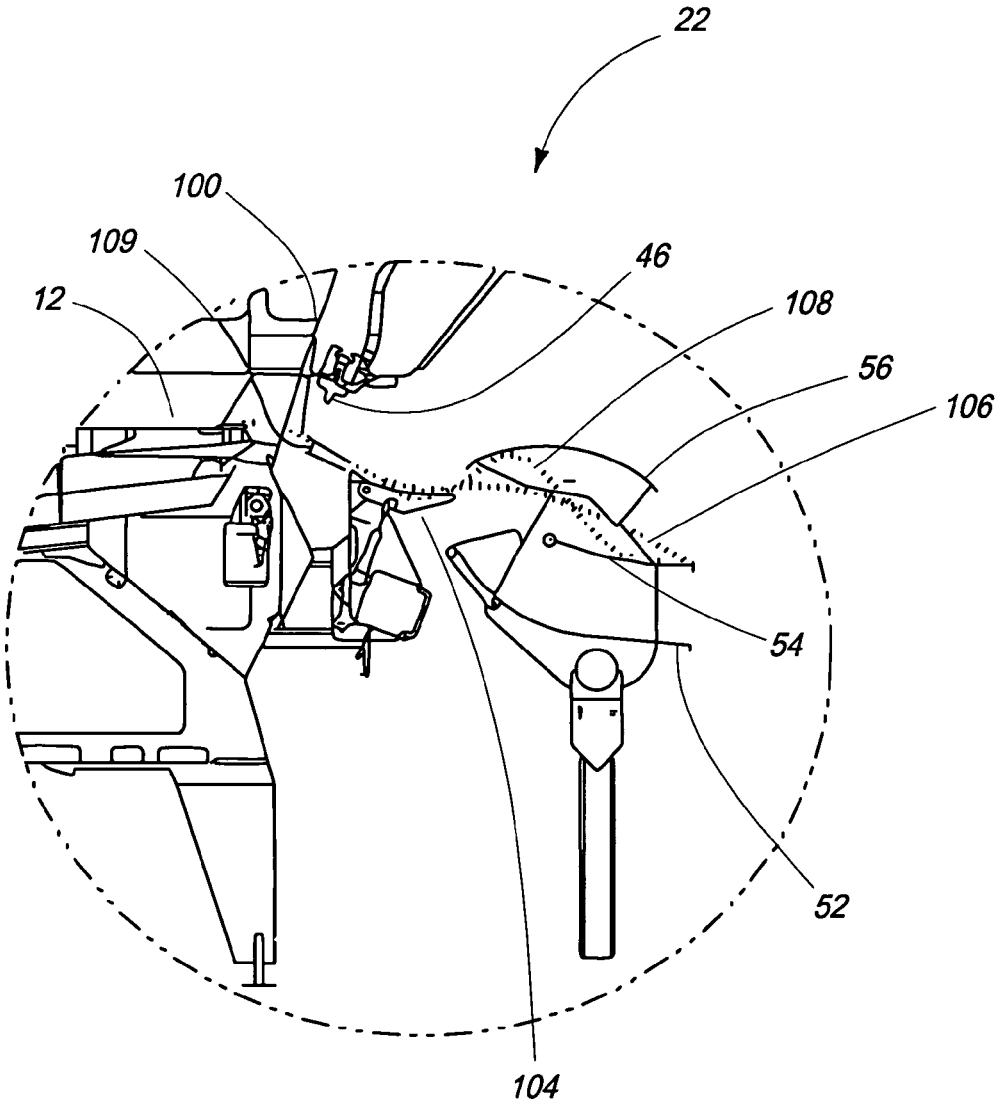
FIG. 6 is a side elevation view of a separation assembly used with the first form of the sorting apparatus, and which shows a trace of a gentle trajectory, and a trace of an aggressive trajectory.

Referring now to FIGS. 2, 5 and 6 the product stream 12, as illustrated, includes acceptable articles which are generally designated by the numeral 30; unacceptable articles which are generally designated by the numeral 32; and foreign material which is generally designated by the numeral 34. The product stream 12 is transported by the endless belt conveyor 16, and is launched, therefrom, as it passes through the inspection station 20, and the routing assembly 22, and into an initial or normal trajectory 100. From a study of FIG. 2, it will be recognized that the product stream 12 is shown as a single virtual lane 21 (FIG. 1) of articles, although in one form of the invention, the sorter 10 includes a plurality of virtual lanes 21 which are arranged across the width of the sorter 10.

The inspection station 20 includes a first camera 36 which is positioned to view the product stream 12 as it is transported by the endless belt conveyor 16. A second camera 38 is positioned to provide a downwardly looking view of the product stream 12 after it has been launched off of the endless belt conveyor 16. A third camera 40 is positioned to provide an upwardly directed view of the product stream 12 after it has been launched off of the endless belt conveyor 16. It should be understood that the inspection station 20 may also be configured to include either a fewer, or a greater number of cameras, or other types of optical sensors including photodiodes, photomultiplier tubes, or other types of imaging or sensing devices known in the art without departing from the teachings of this invention.

The inspection station 20 also includes a sorting processor 42 that is connected to each of the above identified cameras 36, 38, and 40, and which is operable to process electrical signals produced by each of the cameras so as to provide resulting data indicative of the physical characteristics of the articles, and foreign material, which are present in the product stream 12. The sorting processor 42 compares these signals, or data, with guidance provided by an operator (via the user interface 18 (FIG. 1)), to provide a resulting plurality of routing signals 44 which command actuators in the routing assembly 22 whose structure and function will be discussed in further detail, below.

The routing assembly 22 also includes an ejector 46 which is positioned above, and directed toward, the product stream 12. It is also operably connected to one of the routing signals 44. The ejector 42 is composed of a plurality of solenoid valves, and associated fluid powered jets which are arranged across the width of the sorter 10, and which operate to direct a pulse of fluid (typically air) toward the product stream 12 to dislodge an article or foreign material targeted by the sorting processor in response to the received routing signal 44 which is derived from the product stream 12. Each of the plurality of jets in the ejector 42 are individually associated with one virtual lane 21 (FIG. 1) as discussed, above. In a preferred embodiment of the sorter 10, foreign material pieces 34 are targeted, and extracted, from the product stream so as to travel in a downwardly directed manner toward an ejector chute 48, and along the foreign material trajectory which is labeled 104.

The routing assembly 22 also includes a mechanical diverter assembly 50 which operably receives the routing signals 44. The routing signals represent commands provided by the sorting processor 42 which is formed, in part, of a general purpose computer, not shown. The diverter assembly 50 is positioned beneath the product stream 12, and oriented in a manner so that it can physically interact with the product stream 12 so as to efficiently route articles in the product stream 12, to a lower slide 52, and an upper slide 54. An upper guide 56 is provided, and positioned above the upper slide 54 whose operation will be discussed in further detail, below.

In one form of the invention, acceptable articles 30 are routed through the region defined between the lower slide 52, and the upper slide 54, and follow the normal trajectory 100 until encountering the lower slide 52. Also in this first form of the invention, unacceptable articles 32 are routed through the region defined between the upper slide 54, and the upper guide 56, and follow either a gentle trajectory 106, or an aggressive trajectory 108. The diverter assembly 50 is shown in a retracted position 102 in FIG. 5 and in an extended position 104 in FIG. 6.

Figure 3:
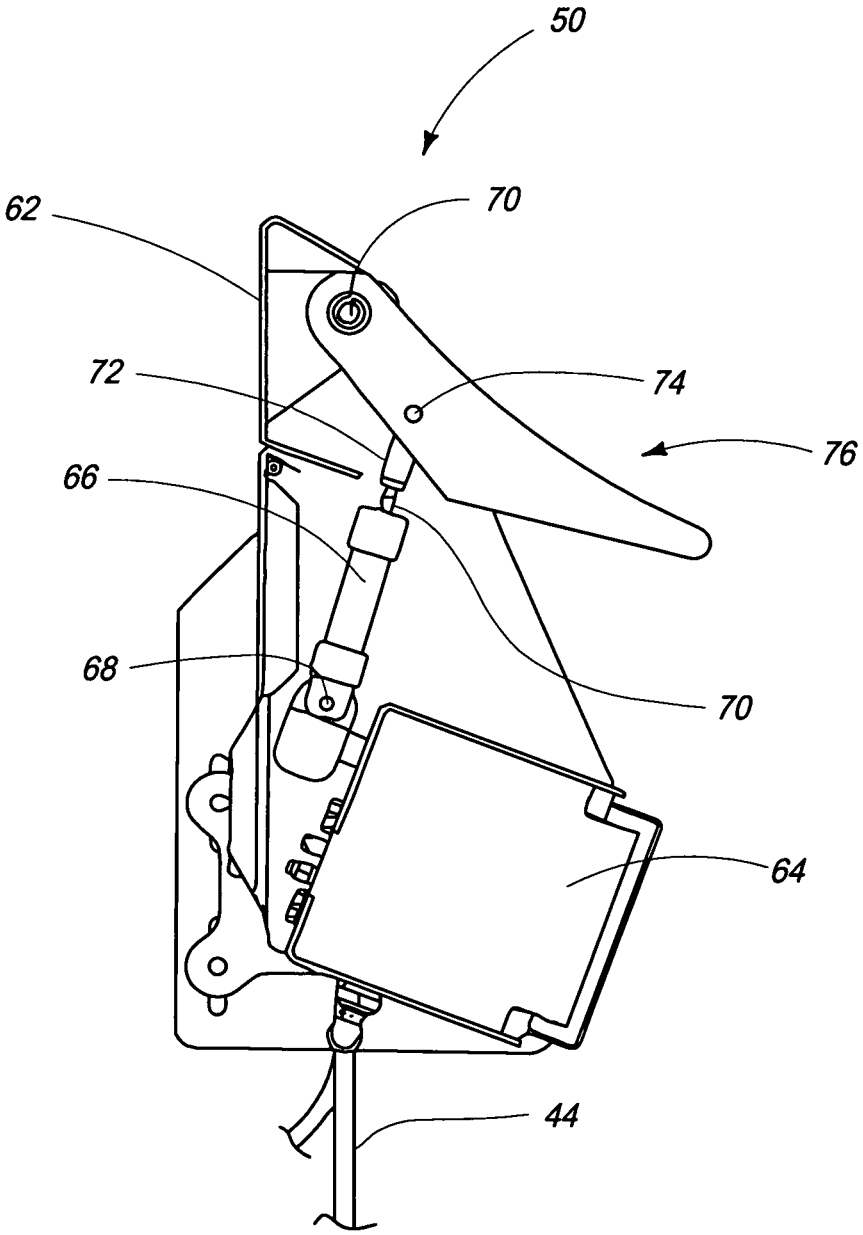
FIG. 3 is an elevation view of a single diverter that is employed in the first form of the sorting apparatus.

Now referring to FIG. 3, the diverter assembly 50 also includes a mounting frame 62 which is fastened to the sorter 10, and which extends in transverse relation underneath the product stream 12. A valve assembly 64 is borne by the mounting frame 62, and is operably coupled to some of the routing signals 44. The valve assembly 64 includes a manifold for the transfer of an air supply, and a plurality of solenoid valves are juxtaposed relative thereto, and is operably controlled by the plurality of routing signals 44.

A plurality of actuators 66 are coupled in fluid transmission controlling relation relative to the plurality of solenoid valves in the valve assembly 64. They are further each borne by the mounting frame 62 on a plurality of actuator pivot pins 68. Each actuator has a rod 70 which is operable to positionally respond to fluid pressure. A bracket 72 is fastened to each rod 70.

A plurality of launching blocks 76 are pivotally positioned in juxtaposed relation between a plurality of pivot pins 70 that are located on the mounting frame 62, and between the bracket 72. A block pin 74 retains the launching block 76 to the bracket 72. Each launching block 76 is fastened in such a manner that an extension of the rod 70 of the actuator 66 effectively raises a portion of the launching block 76 thereby enabling a controllable physical interaction with the product stream 12, and which is effective in routing articles in response to the commands received from the sorting processor 42 (FIG. 2). Each of the plurality of launching blocks 76 is associated with a virtual lane 21 (FIG. 1) of the sorter 10.

In a preferred embodiment, the actuator 66 is a pneumatic cylinder having a sufficient piston area so as to accurately, and quickly position the launching block 76 in a given position in response to commands from the sorting processor 42.

Figure 4A:
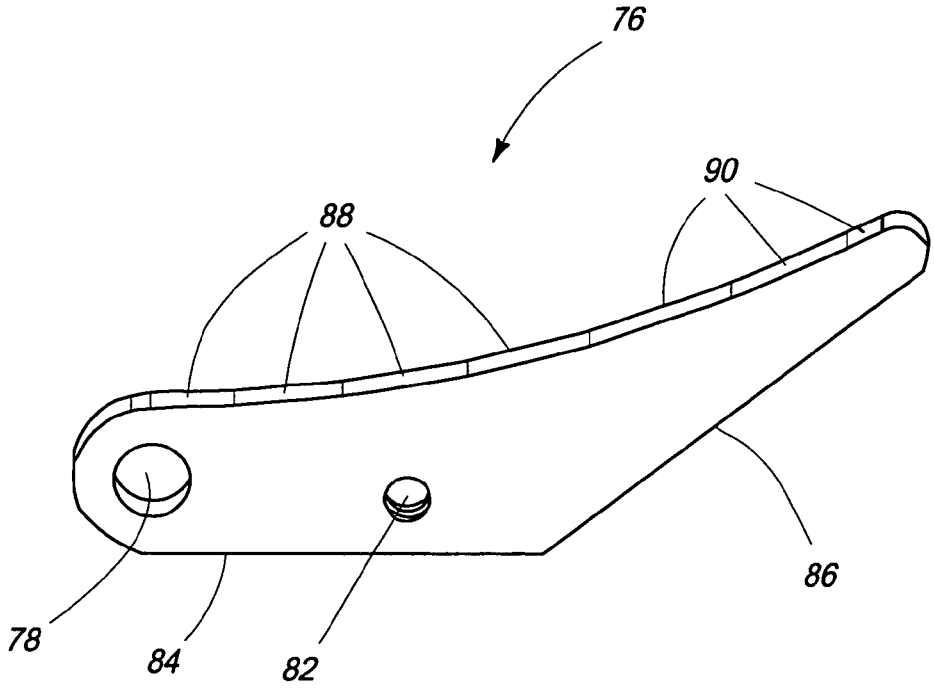
FIG. 4*a* is a perspective view of a launching block from the diverter employed in the first form of the invention.
Figure 4B:
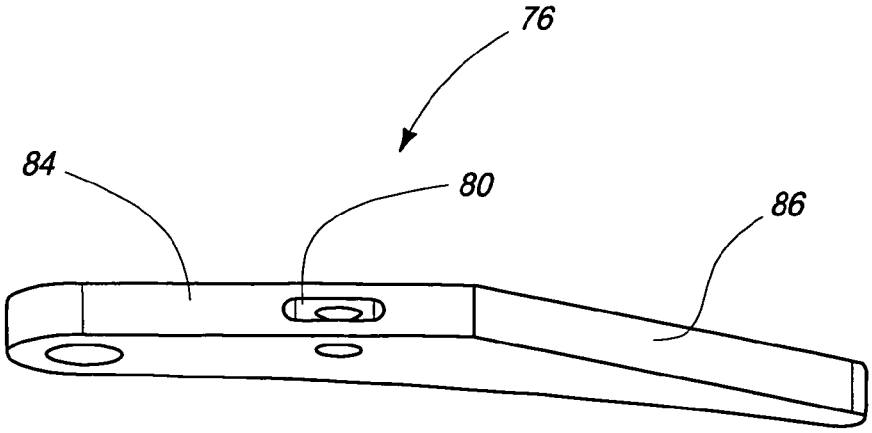
FIG. 4*b* is an inverted perspective view of a launching block from the diverter employed in the first form of the invention.

Now referring to FIGS. 4*a* and 4*b*, the launching block 76 is fabricated by using an industrial plastic or other synthetic material, and which further has a pivot aperture 78 formed therein, and fashioned to accept the pivot pin 70 (FIG. 3). A notch 80, and a bracket pin aperture 82 are each formed in the launching block 76. The combination of the notch 80, and the aperture 82 form a clevis which is fabricated to accept the bracket 72 (FIG. 3) and the block pin 74. The launching block 76 has a base surface 84, and which extends to a front surface 86, and which further extends forwardly at an obtuse angle. Located opposite the base surface 84, is a contact surface 88 having a generally concave-like shape. Adjacent to this surface is a launching surface 90 which also has a concave shape.

Now referring to FIGS. 4*a* and 6, the launching block 76 is fashioned so that, when the diverter assembly 50 is located in the extended position 104, that a nominal angle 109 exists between the normal trajectory 100, and the contact surface 88 of the launching block 76. It has been discovered that minimizing this nominal angle 109 is helpful in reducing the bruising of the articles as they contact the launching block 76. In this form of the invention, the nominal angle 109 is less than 20 degrees.

Figure 7:
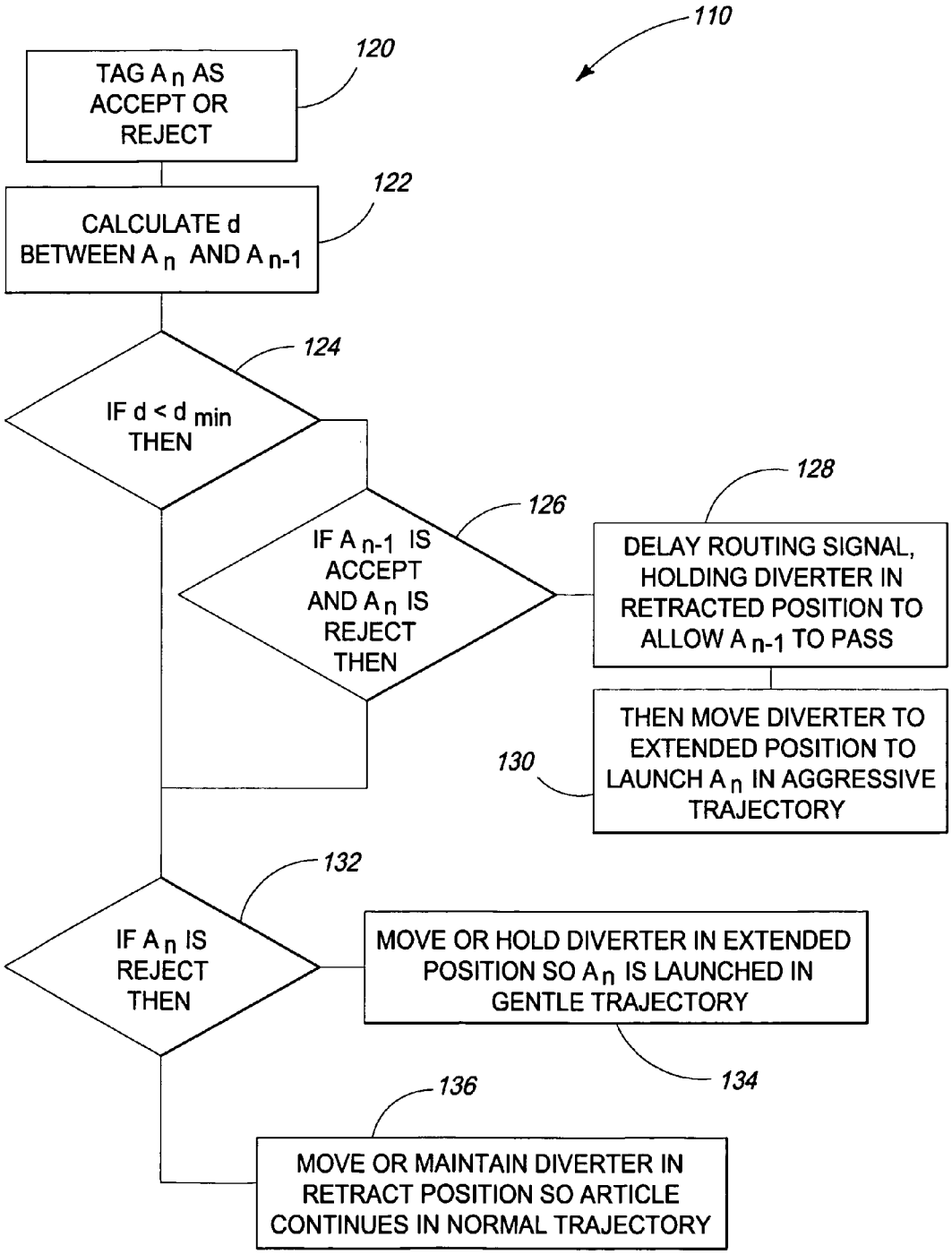
FIG. 7 is a flow chart of the diverter control routine for the first form of the sorting apparatus of the present invention.

Now referring to FIGS. 2 and 7, the sorting processor 42 is configured to run a multiplicity of routines or operational tasks and processes, as it fulfills its mission in the sorter 10. One such routine is a diverter control routine 110 which is composed of a number of steps that optimally control the diverter assembly 50 to accurately route articles according to directives or commands sent from the sorting processor 42. In FIG. 7, it will be seen that a tag step 120 is followed by the sorting processor 42 where a current article, referred herein as $A_n$, is tagged as either ACCEPT or REJECT. The tag step 120 is followed by a calculation step 122 where a distance value is computed which approximates the distance between a current article $A_n$ and an immediately preceding article located within a given or adjacent virtual lane 21 (FIG. 1). This distance value is referred herein as $A_{n-1}$.

The calculation step 122 is followed by a distance threshold decision 124 where the distance is compared with a predefined minimum distance value referred herein as $d_{min}$. If the distance threshold decision 124 is true, then a type decision 126 is made based upon the review of the tag of each of $A_n$ and $A_{n-1}$. If the type decision 126 is true, then a delay step 128 is performed followed by an aggressive reject step 130.

Still referring to FIG. 7, If the distance threshold decision 124, or the type decision 126 is false, then a reject decision 132 is made. If the reject decision 132 is true, then a gentle reject step 134 is performed. If the reject decision 132 is false, then a pass step 136 is performed.

The operation of the first form of the invention is believed to be readily apparent and is briefly summarized in the paragraphs which follow.

In operation, and referring to FIGS. 1-4, the incoming product stream 12 traveling in the flow direction as indicated by the arrow numerated as 14, is delivered to the sorter 10 in a substantially continuous fashion. As illustrated, the product stream 12 is transported by the conveying means or endless belt conveyor 16 through the sorter 10 in a plurality of virtual lanes 21, and is further transported, and then launched ore released to move through the inspection station 20. The sorting processor 42 in the inspection station 20 receives, and then provides information from, and to, an operator through the user interface 18. This information enables the accurate operation of the sorter 10 by facilitating the definition of assorted sorting parameters which may include, but are not limited to, tables or regions of acceptable and unacceptable colors; foreign material colors or scatter; size thresholds for acceptable, unacceptable, and foreign material colors; and definitions of desirable and undesirable shape parameters, as well as many others.

Cameras 36, 38, and 40 provide a means for measuring physical characteristics of the objects in the product stream 12, and this measurement data is provided to the sorting processor 20 where it is compared, and contrasted with the sorting parameters discussed, above, so as to render or generate a series of sorting decisions which are manifested by a plurality of routing signals 44.

Now referring to FIGS. 2, 5 and 7, and in one form of the present invention, the product stream 12 is launched or released into an initial or normal trajectory which is generally indicated by the numeral 100. Here a substantial portion of the foreign material 34 in the product stream 12 is detected and tagged by the sorting processor 42, and is diverted from the product stream 12 by the ejector 46 as it responds to the received routing signals 44. This diversion is accomplished by jetting a pulse of air from the ejector 46 toward the foreign material 34 as it travels through the air adjacent to the ejector 46. The foreign material 34 responds to the jet of pulsed air by translating or otherwise moving in a downwardly and diverging path of travel from the product stream 12, and in a direction toward the ejector chute 48 where it is received for further processing or disposal.

In this first form of the invention, a substantial portion of the acceptable articles 30 are detected, and then tagged by the sorting processor 42 by means of the diverter control routine 110 in the tag step 120 as ACCEPT, and further allowed to travel in the normal trajectory 100, uninfluenced by the ejector 46. Still further, the sorting processor 42, in the pass step 136, provides routing signals 44 to the diverter assembly 50 to move, or maintain it, in a retracted position as shown in FIG. 5. This allows the acceptable articles 30 to pass, without substantial interaction with the launching block 76, as they continue to travel in the normal trajectory 100. The acceptable articles 30 continue to travel, and are ultimately guided by the lower slide 52, where they are discharged for further processing.

Now referring to FIGS. 1, 2, 3, 6 and 7, and in this form of the invention, a substantial portion of unacceptable articles 32 are detected and tagged by the sorting processor 42 by the diverter control routine 110 in the tag step 120 as REJECT. When this event occurs, the sorting processor 42 measures or calculates the distance between a current article $A_n$, and a preceding article $A_{n-1}$ that is located in a current or adjacent virtual lane 21 which is associated with $A_n$ in the calculate step 122. In the next step of the methodology, a distance threshold decision 124 is accomplished. If the distance threshold decision 124 is true, meaning that the distance is less than a minimum distance, then the type decision 126 is made based on the tag of $A_n$ and $A_{n-1}$.

In the described methodology, if $A_{n-1}$ is ACCEPT and $A_n$ is REJECT then the type decision 126 is true, and the delay step 128 will be performed. Here it should be understood that the routing signal 44 will be delayed, thereby holding the diverter assembly 50 in the retracted position 102, so as to allow $A_{n-1}$ to pass thereby. Then, after the delay step 128 is completed, the aggressive step 130 is performed, so that the diverter assembly 50 is moved to launch $A_n$ into the aggressive trajectory 108 because the sorting processor 42 issues a routing signal 44 which causes the valve assembly 64 to supply fluid to the actuator 66 so as to cause the rod 70 to control the position of the launching block 76. In this process, the unacceptable articles 32 encounter the launching block 76 proximate to the contact surface 88 as it is moved from the retracted position 102 to the extended position 104. This movement imparts an upwardly directed force on the article, and causes it to deviate from the normal trajectory 100, and follow a path which is substantially similar to the aggressive trajectory 108. The unacceptable article 32, on the other hand, may encounter the upper guide 56, and/or the upper slide 54, where it is discharged for further processing. This aspect of the operation of the sorter 10 enables the efficient diversion of unacceptable articles 32 that are in the proximity of acceptable articles 30 in the same, or adjacent virtual lanes 21. This also allows the acceptable articles 30 to pass in the normal trajectory 100.

Alternatively, if the type decision 126 is false, or if the distance threshold decision 124 is true, then the reject decision 132 is performed by the sorting processor 42. If the reject decision 132 is true, that is, if $A_n$ is tagged as REJECT, then the diverter assembly 50 is moved to the extended position 104 in a manner similar to that previously discussed, above. If the diverter assembly 50 was already in the extended position 104, then it is maintained in that position. In either case, the unacceptable article 32 will encounter the launching block 76 when it is already at the extended position 104, so that it encounters the contact surface 88. Once again, it will slide on or along the contact surface 88, and travel to the launching surface 90 which will then redirect the motion of same and which further provides a smooth translation so that it is launched into the gentle trajectory 108. This gentle trajectory has a minimal upwardly directed motion, and travels until it encounters the upper slide where it is discharged for further processing.

Second Form

Referring now to FIGS. 8-12, respectively, a second form of the present invention is shown therein, and which is generally indicated by the numeral 200. This form of the invention, in operation, is characterized by features which minimize damage to the product being sorted and which further reduces the vertical height of the resulting apparatus 200. In the second form of the invention as depicted in FIGS. 8-12, it will be seen that the sorting apparatus of the present invention includes a continuous conveyor which is generally indicated by the numeral 201. The continuous conveyor is similar to that described with respect to the first form of the invention. The conveyor has an upwardly facing supporting surface 202, and a distal end 203. The continuous conveyor 201 is operable for transporting a multiplicity of articles 204 in a continuous product stream. The product stream includes acceptable articles 205; unacceptable articles 206; and foreign debris which is generally indicated by the numeral 207. As will be understood from the description which follows, the acceptable articles 205 are articles having a first predetermined sorting characteristic, the unacceptable articles 206 are articles having a second predetermined sorting characteristic, and the foreign debris are articles having a third predetermined sorting characteristic.

Figure 12:
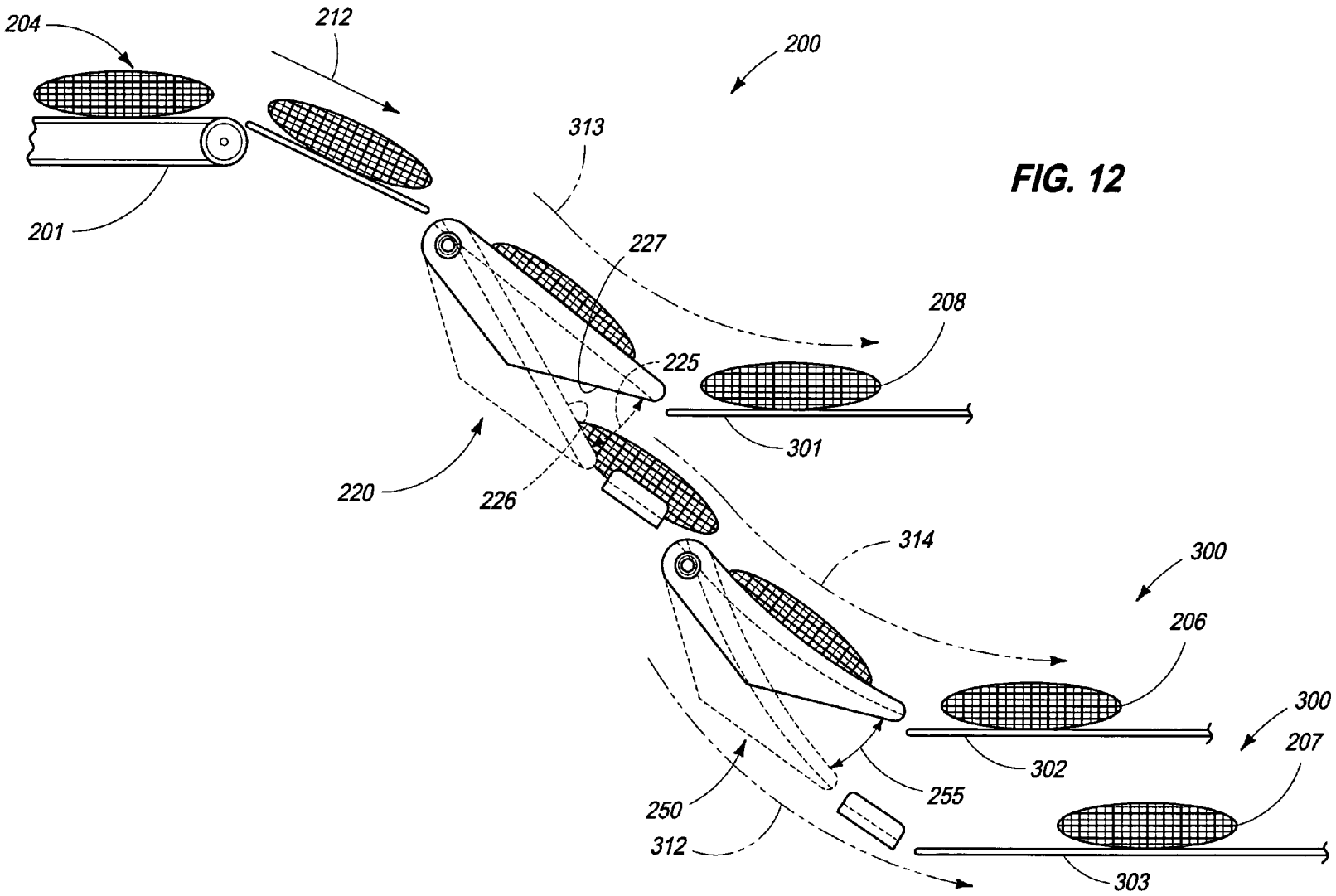
FIG. 12 is a fragmentary, greatly simplified, schematic view of the second form of the invention while in operation.

Referring now to FIG. 12, the invention as described hereinafter is discussed as it would be configured to sort a stream of articles, here depicted as ears of corn. However, the same teachings could be utilized to sort any number of different types of agricultural or other objects of interest.

Figure 11:
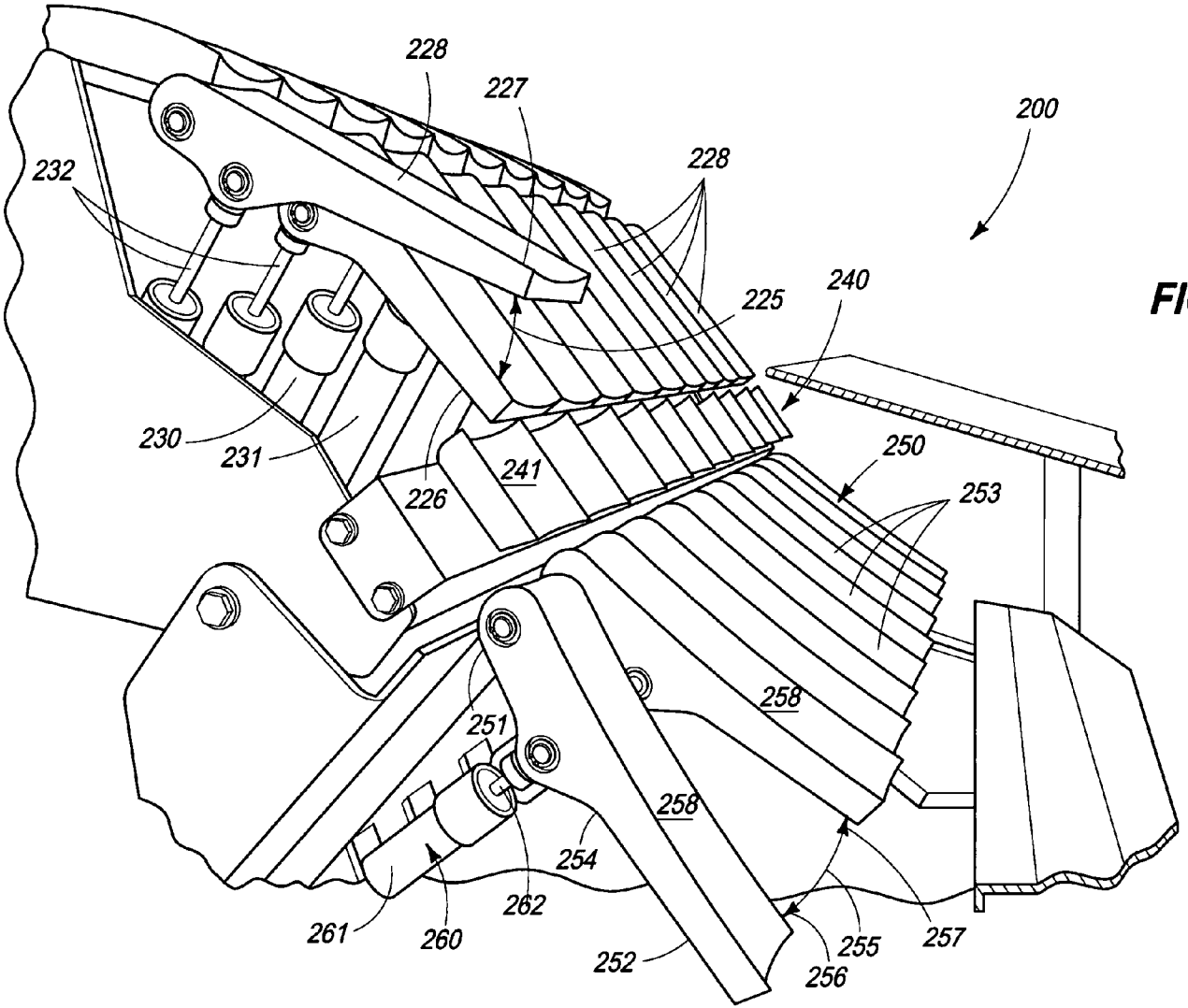
FIG. 11 is still another perspective, side elevation view of the second form of the invention during one mode of operation.

With respect to the second form of the invention 200, the invention further includes a first downwardly directed, multiple-laned article orienting ramp which is generally indicated by the numeral 210. This multiple-laned orientation ramp 210 causes the articles to be sorted, 204, to be moved into discrete lanes so that they may move through the inspection station, as will be described, below. In the case where the articles to be sorted 204 represent ears of corn, as depicted in FIG. 12, this multiple-laned article orientation ramp would tend to cause the individual ears of corn to move into a predetermined spacial orientation, one relative to the others, for passage through an inspection station as will be described. It will be recognized that upon leaving the distal end 203 of the continuous conveyor 201, the articles 204 move onto the upwardly supporting surface 211 of the multiple-laned orientation ramp. The articles 204 thus begin to move along a first path of travel 212. As best seen in FIG. 11, for example, the upwardly supporting surface 211 defines multiple individual lanes 213 along which the individual articles 204 travel. The articles 204 move past an inspection station 214 (FIG. 8), which was earlier described with respect to the first form of the invention 10. In the present arrangement, it will be understood that the inspection that takes place of the articles 204 only takes place from a location which is immediately above the articles in the first path of travel 212. The inspection station 214 is operable to provide a multiplicity of routing signals 215, following the inspection of the product stream, and send them to a general purpose computer or processor which then compares and contrasts the signals to make decisions regarding the presence of acceptable articles 205; unacceptable articles 206; and foreign debris 207, or articles having predetermined first, second and third sorting characteristics, as earlier described. As should be understood, the inspection zone could, in another form of the invention, be conducted through a gap provided in the first surface 202, or it may be conducted on the orientation ramp 210.

In FIGS. 8-12 it will be recognized that the second form of the invention 200 includes a first plurality of launching blocks which are generally indicated by the numeral 220, and which are positionally located in a downstream relation relative to the multiple-laned article orienting ramp 210. The individual launching blocks forming the first plurality 220 have a first or proximal end 221; and a second or distal end 222. As will be appreciated by studying the drawings, the proximal end 221 rotates, at least in part, about a given horizontally disposed axis. Each of the launching blocks forming the first plurality 220 include an upwardly facing, substantially flat surface 223 which is operable to support, or otherwise physically interact with the individual articles 204 which are to be sorted. Still further, the first plurality of launching blocks 220 each have a downwardly facing surface 224. The respective launching blocks are operable to move along individual paths of travel 225, from a first, retracted position 226, to a second or extended position 227 in order to effect sorting of the articles 204 based upon the routing signals 215 which are supplied by the inspection station 214. As will be recognized in FIG. 10, the upwardly facing surface 223 of the first plurality of launching blocks 220 define individual longitudinally extending channels 228 which are each substantially coaxially aligned relative to the respective lanes 213 that are defined by the article orienting ramp 210. The coaxially alignment of these two features allows the articles 204 to continue to move along a substantially linear first path of travel 212.

As seen in FIGS. 8-12, and as earlier discussed in significant detail, the second form of the invention 200 includes a multiplicity of fluid powered actuators 230 which each have a main body 231 which is coupled with a source of fluid under pressure, typically air, and which further has a moveable actuator or other piston rod 232 having a distal end which is pivotally affixed to the respective launching blocks forming the first plurality thereof 220. The actuators 230 are operable to move the individual launching blocks forming the first plurality 230 along the previously described path of travel 225 between the first retracted position or normally down position 226, and the second extended or normally up position 227, to perform the features as described hereinafter. The individual actuators are rendered operable by the same means, earlier described, with respect to the first form of the invention 10. Therefore, the structure and operation will not be repeated herein. As will be seen in the drawings, a second, downwardly directed multiple-laned article orienting ramp 240 is provided, and which is located in product stream receiving relation relative to the distal ends 222 of the first plurality of launching blocks 220 when the respective launching blocks are in the first retracted position 226. As seen in FIGS. 8-12, the second downwardly directed article orienting ramp 240 includes individual upwardly facing and concavely shaped lanes 241 which are individually coaxially aligned relative to the channels 228 that are individually defined by the respective first plurality of launching blocks 220.

Figure 10:
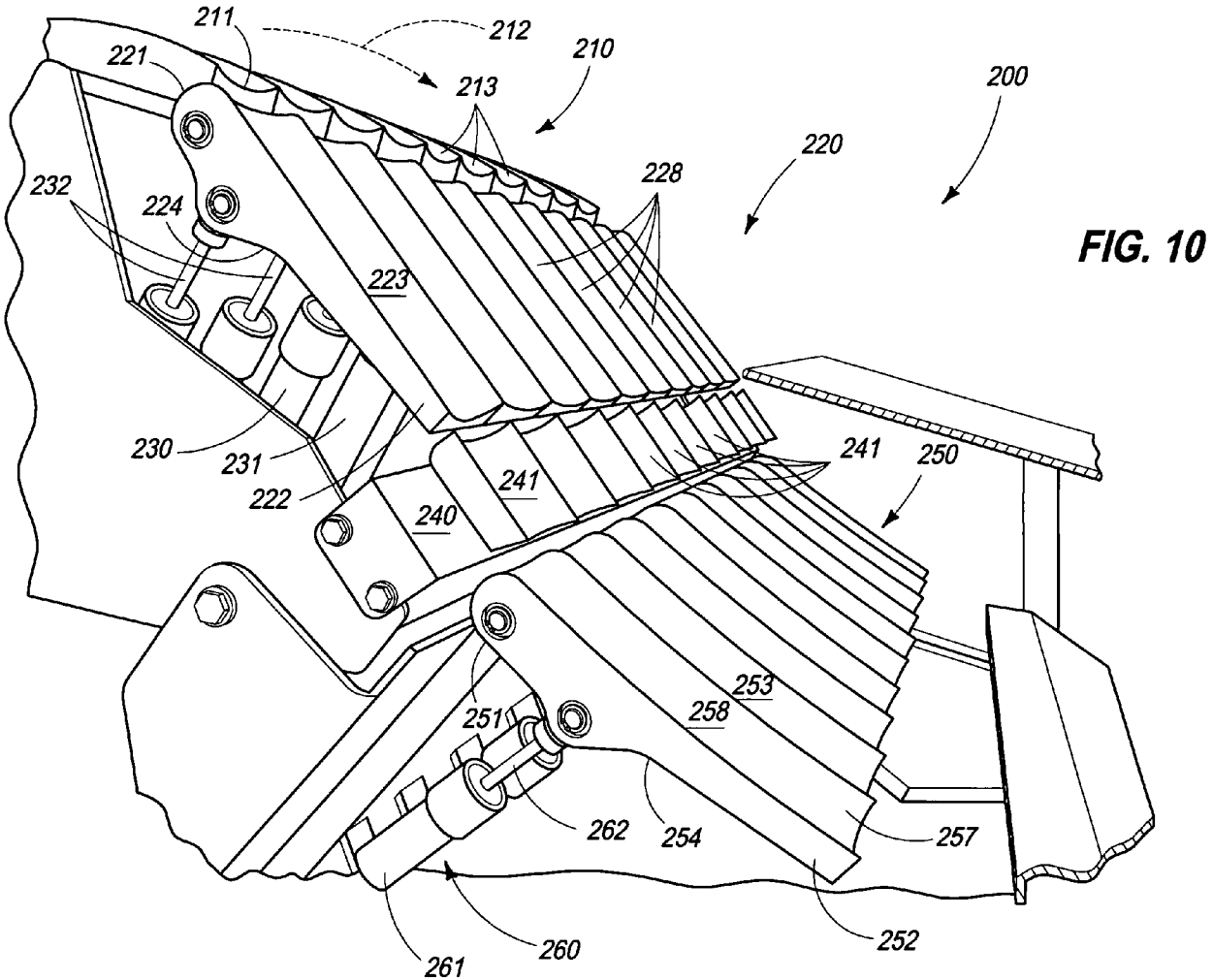
FIG. 10 is yet another perspective, side elevation view of the second form of the invention during one mode of operation.

The present invention 200 also includes a second plurality of launching blocks 250 which are located downstream relative to the second downwardly directed multiple-laned article orienting ramp 240. As will be recognized by studying the drawings, the length of the second multiple-laned article orienting ramp is typically less than the length of the articles 204 which are being sorted However, in certain forms of the invention, the length of these second multiple-laned article orienting ramp may be larger. In large measure, the length of these structures are used to maintain the alignment of the articles 204, and to further establish a given distance between the first and second ramps 301 and 302, respectively which will be discussed in greater detail hereinafter. The respective launching blocks of the second plurality 250 each have a first or proximal end 251 which is pivotally affixed to a frame, and a second, distal or moveable end 252. The respective launching blocks of the second plurality 250 further have an upwardly facing, concavely shaped surface 253, and a downwardly facing surface 254. As earlier discussed with respect to the first plurality of launching blocks 220, the second plurality 250 moves along an arcuately shaped path of travel 255, between a first, retracted or normally down position 256, and a second, extended or normally up position 257. As seen in FIG. 10, and following, it will be recognized that the upwardly facing concavely shaped surface 253 defines individual longitudinally extending channels 258 which are substantially coaxially aligned with the individual upwardly facing concavely shaped lanes 241 which are defined by the second multiple-laned article orienting ramp 240. Similar to that earlier described, a second bank or group of fluid powered actuators 260 are provided and which are individually coupled in selective force transmitting relation relative to the individual launching blocks that make up the second plurality thereof 250. Again, this second group or bank of fluid powered actuators 260 include a main body 261, and a moveable actuator or piston rod 262 which has a distal end, and which is pivotally affixed to the downwardly facing surface 254 and which is further operable to move the individual launching blocks making up the second plurality along the path of travel 255, as earlier described.

Figure 9:
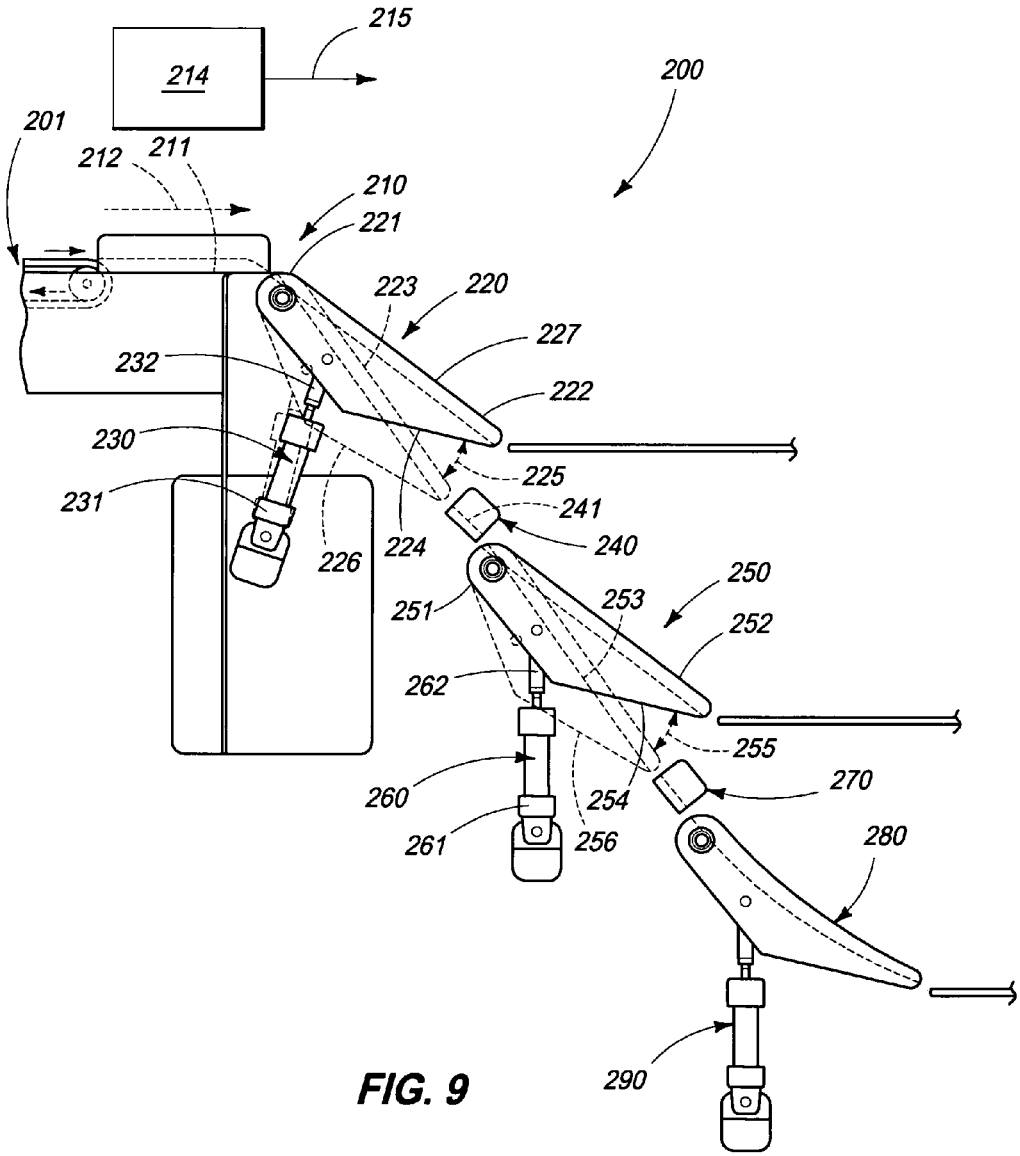
FIG. 9 is a fragmentary, side elevation view of yet another form of the present invention during one mode of operation.

Referring more specifically to FIG. 9, it will be appreciated that the second form of the invention may include a third, downwardly directed multiple-laned article orienting ramp 270 which is positioned in substantially coaxial alignment relative to the second plurality of launching blocks 250. Further, a third plurality of individually moveable launching blocks 280; as well as a third bank of fluid power actuators 290 may be provided, and which have the same structural, and functional attributes as that earlier described with respect to the assemblies upstream, therefrom. Based, at least in part, upon the number of sorting characteristics desired, this particular arrangement may be repeated a number of different times in order to achieve the benefits of the present invention.

Figure 8:
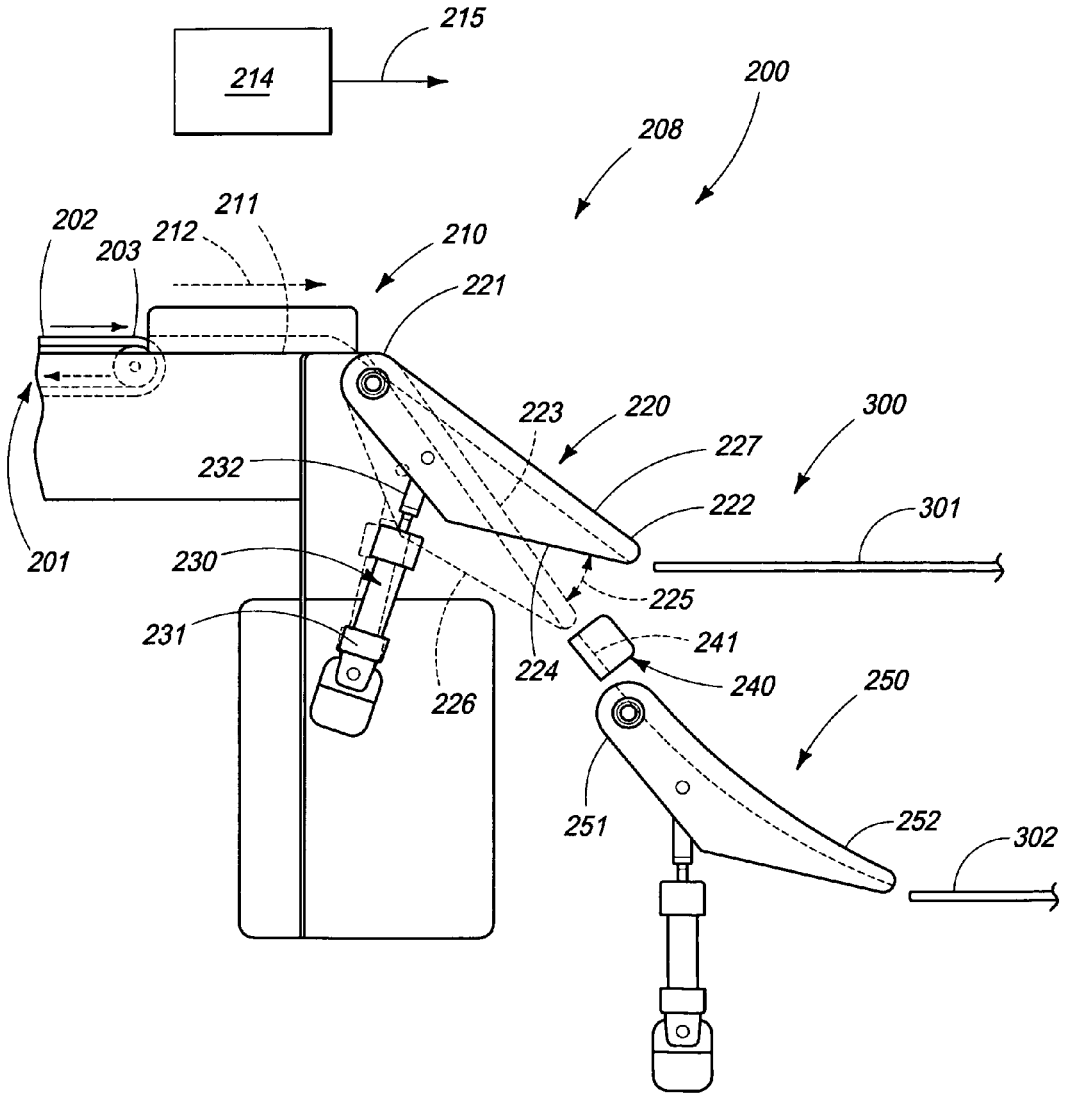
FIG. 8 is a fragmentary, side elevation view of a second form of the present invention during one mode of operation.

With regards to the second form of the invention 200, it will be seen from the drawings in FIG. 8, and following, that the present form of the invention includes a multiplicity of article receiving ramps which are generally indicated by the numeral 300. As illustrated in the drawings, a first and second ramp 301 and 302, respectively, are provided. The first article receiving ramp 301 is located in spaced, article receiving relation relative to the second, or distal end 222 of the first plurality of launching blocks 220 when the first launching blocks have been moved to the second, extended position 227. Further, the second article receiving ramp 302 is located in spaced, article receiving relation relative to the second, or distal end 252 of the second plurality of launching blocks 250 when the respective launching blocks are in the second, extended position 257. As seen in the drawings, the second article receiving ramp 302 is located below, and is oriented in spaced relation relative to the first article receiving ramp 301. A passageway 303 is located between the distal end 252 of the respective launching blocks, of the second plurality 250, when the distal ends 252 of the respective launching blocks are in the first, retracted position 256.

As should be understood by studying the drawings, the second form of the invention 200 defines three courses, or paths of travel for the articles 204 to be sorted. In particular, the invention defines a first path of travel 212; a second path of travel 312; a third path of travel 313; and a fourth path of travel 314. It should be apparent, that as additional groups or pluralities of launching blocks are added to the structure that additional courses of travel could be defined. As will be appreciated, the second, third, and fourth paths of travel each represent a discrete sorting characteristic for the respective articles 204 which are sorted by the second form of the invention 200. As earlier discussed, the first path of travel 212 is defined by the first, downwardly directed multiple-laned article orienting ramp 210. The second course or path of travel 312 is defined when the individual launching blocks in the first and second plurality 220 and 250, respectively, are both in the first retracted position 226 and 256, respectively. This orientation of the aforementioned structures allows the individual articles 204 to move to the lowermost point based upon a first sorting characteristic as determined by the general purpose computer or processor which receives the routing signals 215. Further, the third path of travel 313 is defined when the individual launching blocks of the first plurality 220 are located in the first extended position 227, and the article 204 traveling along same is delivered onto the first article receiving ramp 301. Further, the fourth path of travel 314 is defined for the articles 204 traveling, therealong, when the individual launching blocks of the first plurality of launching blocks 220 are located in the first retracted position 226, and the second plurality of launching blocks are located in the second extended position 257. In this arrangement, the articles to be sorted 204 are received onto the second article receiving ramp 302. The first, second, third and fourth paths of travel are clearly understood by a study of FIG. 12.

Figure 13:
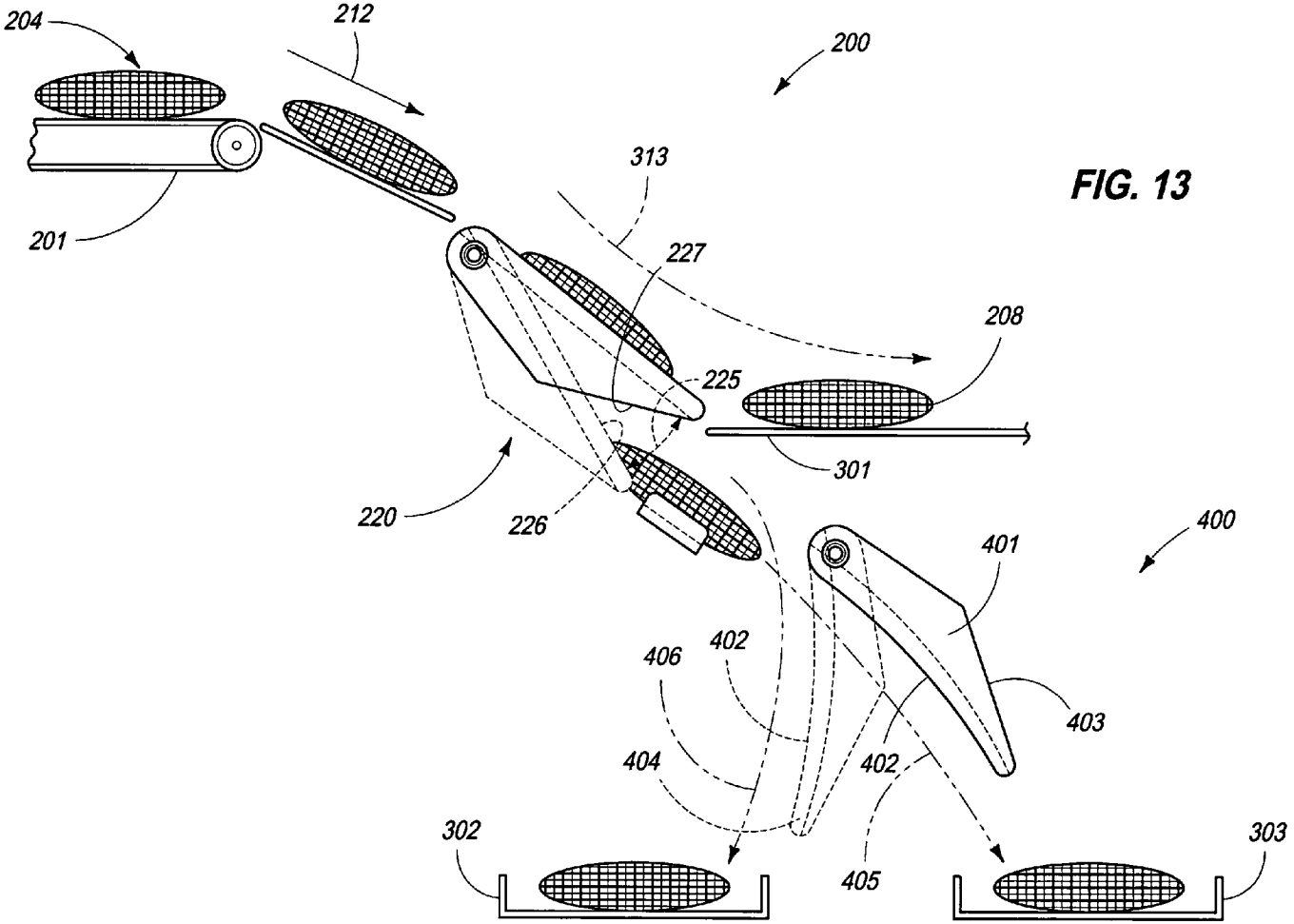
FIG. 13 is a fragmentary, greatly simplified, schematic view of another form of the invention while in operation.

Referring now to FIG. 13, yet another form of the invention 200 is shown. In this view, the earlier mentioned path of travel of the articles is made somewhat variable from that seen in FIG. 12 in view of the provision of a second plurality of individual launching blocks 400 which are inverted from that of FIG. 12. More specifically, the launching blocks 400 have a main body 401 which defines a curved upwardly facing channel 402. Again, as was described with the launching blocks 250, the launching blocks 400 are movable between a first normally up position 403 and second normally down position 404. In this form of the invention it will be seen that the ramps 302 and 303 are oriented side-by-side, and below the ramp 301. Further, in this form of the invention, three courses of travel are defined. Similar to what is seen in FIG. 12, a first course of travel 212 is provided for the articles 204. Additionally, a second course of travel 405 is provided where articles 204 move downwardly to the article receiving ramp 303, and do not typically come into contact with the respective launching blocks 400. In this form of the invention, the invention further includes a third course of travel 406, where articles move into physical contact with the channel 402 and are then directed to the article receiving ramp 302.

Operation

The operation of the described second form of the invention 200 is believed to be readily apparent, and is briefly summarized at this point.

With regards to the second form of the invention 200 which is seen in FIGS. 8-12, respectively, a sorting apparatus 200 is shown, and which includes a conveyor 201 for transporting a multiplicity of articles 204 in a continuous product stream. The continuous product stream includes acceptable 205, and unacceptable 206, articles, and foreign material 207. The conveyor 201 propels the product stream into a first path of travel 212. An inspection station 214 is provided, and positioned along, and in spaced relation relative to the first path of travel 212. The inspection station 214 visually inspects the product stream to identify the respective acceptable articles 205; unacceptable articles 206; and foreign material 207. Further, the inspection station generates a plurality of routing signals 215 following the inspection of the product stream. A diverter assembly which is generally indicated by the numeral 208, is located downstream of the inspection station 214, and in spaced relation relative to the conveyor 201. The diverter assembly 208 is controlled by the plurality of routing signals 215 which are supplied by the inspection station 214. The diverter assembly has a first and second plurality of selectively moveable launching blocks 220 and 250, respectively. As seen in the drawings, the individual launching blocks are substantially identical in length and in their overall shape. However, it is conceivable that the respective launching blocks could have different lengths depending on the articles 204 being sorted. The second plurality of launching blocks 250 are located downstream of, and in substantially gravitationally feeding alignment with, the respective first plurality of selectively moveable launching blocks 220. The individual moveable launching blocks 220 and 250 each are moveable between a first, retracted position 226/256, and a second, extended position 227/257. When the individual launching blocks of the first and second plurality are both in the retracted position 226/256, the individual articles 204 moving along in the product stream move along a second path of travel 312 (FIG. 12). Further, when the individual moveable launching blocks of the first plurality 220 are in the extended position 227, the individual articles moving along in the product stream move along a third path of travel 313 (FIG. 12). Still further, and in the arrangement as shown in the drawings, when the individual moveable launching blocks of the first plurality 220 are in a retracted position 226, and the second plurality of launching blocks are in an extended position 257, the individual articles 204 travelling along in the product stream move in a fourth path of travel 314 (FIG. 12). The second 312, third 313 and fourth 314 paths of travel effect the appropriate sorting of the articles 204 in the product stream. As discussed, above, the respective paths of travel each correspond to individual, predetermined sorting criteria as determined by the user of the apparatus and as implemented by the earlier discussed general purpose computer or processor.

Therefore it will be seen that the present invention provides a convenient means by which articles to be sorted may be readily diverted into various paths of travel based upon sorting criteria which is established by a user in a manner which has not been possible, heretofore.

In compliance with the statute, the invention has been described in language more or less specific as to structural and methodical features. It is to be understood, however, that the invention is not limited to the specific features shown and describe, since the means herein disclosed comprise preferred forms of putting the invention into effect. The invention is, therefore, claimed in any of its forms or modifications within the proper scope of the appended claims appropriately interpreted in accordance with the doctrine of equivalents.

What we claim is:

1. A sorting apparatus, comprising:

a conveyor for transporting a multiplicity of articles in a continuous product stream, and which includes acceptable and unacceptable articles, and foreign material, and propel the product stream into a first path of travel;

an inspection station positioned along the first path of travel, and wherein the inspection station visually inspects the product stream to identify the respective acceptable articles, unacceptable articles and foreign material, and further generates a plurality of routing signals following the inspection of the product stream; and a diverter assembly located downstream of the inspection station, and in spaced relation relative to the conveyor, and wherein the diverter assembly is controlled by the plurality of routing signals supplied by the inspection station, and further has a first and second plurality of selectively moveable launching blocks, and wherein the second plurality of launching blocks are located downstream of, and in substantially gravitationally feeding alignment with, the respective first plurality of selectively moveable launching blocks, and wherein the individual moveable launching blocks of the first and second plurality each have a first, retracted position, and a second, extended position, and wherein, when the individual launching blocks of the first and second plurality are both in the retracted position, the individual articles moving along in the product stream move along a second path of travel; and wherein when the individual moveable launching blocks of the first plurality are in the extended position, the individual articles moving along in the product stream move along a third path of travel; and wherein when the individual moveable launching blocks of the first plurality are in a retracted position, and the second plurality of launching blocks are in an extended position, the individual articles travelling along in the product stream move in a fourth path of travel, and wherein the second, third and fourth paths of travel effect the sorting of the articles in the product stream.

2. A sorting apparatus as claimed in claim 1, and wherein the individual launching blocks each have an upwardly facing surface which defines a channel along which the individual articles of the product stream travel, and wherein the respective channels of the first and second plurality of launching blocks are substantially coaxially aligned.

3. A sorting apparatus as claimed in claim 1, and wherein the individual launching blocks each have a proximal receiving end, a distal discharge end, and an intermediate portion located between the proximal and distal ends, and wherein the proximal end of the respective launching blocks rotate, at least in part, about a given horizontally disposed axis.

4. A sorting apparatus as claimed in claim 3, and wherein the proximal end of the first plurality of launching blocks are located adjacent to the first path of travel, and the distal end thereof is located in spaced, upstream relation relative to the proximal end of the respective second plurality of launching blocks.

5. A sorting apparatus as claimed in claim 3, and wherein a fluid powered actuator is mounted to each of the intermediate portions of the of the individual launching blocks, and wherein the respective fluid powered actuators, when rendered operational, move the individual launching blocks between the first, retracted position to the second, extended position.

6. A sorting apparatus as claimed in claim 1, and wherein the articles forming the product stream have an elongated shape, and wherein the respective individual launching blocks position the respective articles in the same relative orientation.

7. A sorting apparatus as claimed in claim 1, and wherein the first and second plurality of individual launching blocks are disposed in a predetermined, spaced relationship, one relative to the other, and wherein the acceptable articles forming the product stream have an elongated shape, and a given length dimension which is greater that the spacial distance which is located between the first and second plurality of launching blocks.

8. A sorting apparatus as claimed in claim 1, and wherein the individual launching blocks forming the first and second plurality of launching blocks each have a length dimension which are similar.

9. A sorting apparatus as claimed in claim 1, and wherein the individual launching blocks forming the first and second plurality of launching blocks each have a length dimension which are different.

10. A sorting apparatus as claimed in claim 1, and wherein the acceptable articles forming the product stream include corn.

11. A sorting apparatus as claimed in claim 1, and wherein the product stream traveling along the second path of travel includes only articles having a first, predetermined sorting characteristic.

12. A sorting apparatus as claimed in claim 1, and wherein the product stream traveling along the third path of travel includes only articles having a second, predetermined sorting characteristic.

13. A sorting apparatus as claimed in claim 1, and wherein the product stream traveling along the third path of travel includes only articles having a third, predetermined sorting characteristic.

* * * * *

UNITED STATES PATENT AND TRADEMARK OFFICE

CERTIFICATE OF CORRECTION

PATENT NO. : 8,662,314 B2
APPLICATION NO. : 13/373961
DATED : March 4, 2014
INVENTOR(S) : Peter T. Jones et al.

It is certified that error appears in the above-identified patent and that said Letters Patent is hereby corrected as shown below:

On the Title Page:

Item (75) Inventors: "Hans G. Halmberger" should be --Hans G. Haimberger--.

Signed and Sealed this
Twentieth Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,662,314 B2
APPLICATION NO. : 13/373961
DATED : March 4, 2014
INVENTOR(S) : Peter T. Jones et al.

It is certified that error appears in the above-identified patent and that said Letters Patent is hereby corrected as shown below:

In the Specification:

Column 3, line 2, "product stream product stream in a second trajectory" should read --product stream in a second trajectory--.

Column 8, line 7, "and then launched ore" should read --and then launched or--.

Signed and Sealed this
Seventeenth Day of June, 2014

Michelle K. Lee

Michelle K. Lee
*Deputy Director of the United States Patent and Trademark Office*